US007904019B2

(12) United States Patent
Kwak et al.

(10) Patent No.: US 7,904,019 B2
(45) Date of Patent: Mar. 8, 2011

(54) BROADCAST SIGNAL AND RECEIVER AND METHOD OF DECODING DIGITAL BROADCAST SIGNAL

(75) Inventors: Kook Yeon Kwak, Anyang-si (KR); Woo Suk Ko, Bucheon-si (KR); Jung Sig Jun, Seongnam-si (KR); Jong Woong Shin, Seoul (KR); Sang Chul Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 937 days.

(21) Appl. No.: 11/337,647

(22) Filed: Jan. 24, 2006

(65) Prior Publication Data

US 2006/0166616 A1 Jul. 27, 2006

(30) Foreign Application Priority Data

Jan. 25, 2005 (KR) ..... 10-2005-0006749

(51) Int. Cl.
*H04H 20/74* (2008.01)

(52) U.S. Cl. ..... 455/3.02; 455/7; 455/13.1; 455/13.2

(58) Field of Classification Search ..... 455/3.01, 455/3.02, 7, 11.1, 39, 13.1, 13.2; 370/464, 370/470–474, 350, 503, 509, 510; 375/316, 375/363–368

See application file for complete search history.

(56) References Cited

U.S. PATENT DOCUMENTS 6,078,592 A * 6/2000 Spiero ..... 370/474
6,347,216 B1 * 2/2002 Marko et al. ..... 455/12.1
6,434,138 B2 * 8/2002 Kersken et al. ..... 370/349
7,624,419 B2 * 11/2009 Shibusawa ..... 725/119
2003/0070172 A1 * 4/2003 Matsuzaki et al. ..... 725/87
2004/0022326 A1 * 2/2004 Morrish et al. ..... 375/316
2004/0132456 A1 * 7/2004 Takeda et al. ..... 455/450
2005/0034156 A1 * 2/2005 Terui ..... 725/40
2006/0039565 A1 * 2/2006 Kim et al. ..... 380/277

FOREIGN PATENT DOCUMENTS

| | | |
|---|---|---|
| DE | 10232096 | 2/2004 |
| EP | 1087585 A2 | 3/2001 |
| KR | 10-2004-0048603 | 6/2004 |
| WO | WO 01/33729 A1 | 5/2001 |

* cited by examiner

*Primary Examiner*—Dominic E Rego
(74) *Attorney, Agent, or Firm*—McKenna Long & Aldridge LLP

(57) ABSTRACT

A tuner included in a digital broadcast receiver tunes a broadcast signal from a transmitter via a re-transmitter. A demodulator demodulates the broadcast signal, and an identification information detector detects identification information of a re-transmission service provided by the re-transmitter from the demodulated broadcast signal. A decoder arranged to decode the modulated broadcast signal, and a controller controls operation of the decoder based upon the identification information detected by the identification information detector. The identification information of the re-transmitter may directly include information identifying a type of the re-transmission service (e.g., a free or charged service) or may include a unique ID number of the re-transmission service, which could be used by the broadcast receiver to determine service type.

17 Claims, 7 Drawing Sheets

BROADCAST SIGNAL AND RECEIVER AND METHOD OF DECODING DIGITAL BROADCAST SIGNAL

This application claims the benefit of Korean Application No. 10-2005-006749, filed on Jan. 25, 2005, which is hereby incorporated by reference as if fully set forth herein.

BACKGROUND OF THE INVENTION

1. Field of the Invention

The present invention relates to digital multimedia broadcasting (DMB), and more particularly, to a broadcast signal and a broadcast receiver and method for decoding the same.

2. Discussion of the Related Art

Digital broadcasting has affected the existing analog radio broadcasting so as to expedite the introduction of digital radio broadcasting. Also, the digital broadcasting makes it possible to provide a digital multimedia broadcasting (DMB) service including data transmission and multimedia services as well as the existing audio radio service.

The DMB adopted by Korea is based on Eureka-147 digital audio broadcasting (DAB) adopted as European terrestrial radio standard. In order to enhance more efficiently multimedia broadcasting performance, Reed-Solomon code and Convolution Interleaver that are robust against burst error on a transmission channel are added to the DAB.

Accordingly, the DMB is robust against noise and distortion on the transmission channel, has high transmission efficiency, and can provide various multimedia services.

Specifically, the transmission channel of the DMB serves as a wireless mobile reception channel and its amplitude is time-varying. Also, Doppler spreading of a received signal spectrum occurs due to the influence of the mobile reception. Considering the transmission/reception under such a channel environment, the DMB transmission method is based on Coded Orthogonal Frequency Division Multiplexing (OFDM).

Since the OFDM scheme uses a plurality of multi-carriers, it is robust against ghost that may occur due to the multi-path. Also, the OFDM scheme has an advantage in that a channel estimation based on a pilot signal is convenient.

The Eureka-147 has been introduced for the DAB but the Eureka-147 has been used as fundamental technology of a terrestrial DMB technology for providing a video service of a small sized moving picture by using a narrow frequency bandwidth of 2 Mhz. Eureka-147 system provides an expandable structure for transmitting multimedia data. That is, the Eureka-147 system provides a packet mode or a stream mode for transmitting the multimedia data. Accordingly, multimedia data can be transmitted with minimum modification of a conventional terrestrial DAB system in the Eureka-147 system.

At this time, the terrestrial DMB service is required to provide multimedia services even under a moving environment regardless of place. In this respect, for service quality, it is important that a shaded area of the downtown, such as building and subway, be provided with a re-transmitter.

In other words, the re-transmitter is provided in a shaded area where it is difficult to receive DMB service due to subway, building areas, a high-rise building, and so on. Thus, the re-transmitter serves as a relay that receives the DMB service transmitted from a broadcasting station and re-transmits the DMB service to a DMB receiver placed in the shaded area.

However, since the terrestrial DMB service is fundamentally provided free of charge, a service provider should bear much expense in ensuring a service area for providing many re-transmitters.

SUMMARY OF THE INVENTION

Accordingly, the present invention is directed to a broadcast receiver and a method of decoding a digital broadcast signal, which substantially obviate one or more problems due to limitations and disadvantages of the related art.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a digital broadcast signal for use in a broadcast receiver for receiving broadcast service data frame a broadcast transmitter includes an encoded data frame which includes a main service channel (MSC), a fast information channel (FIC), and a synchronization channel (SYNC). The MSC includes main service data, and the FIC includes multiplexing configuration information of the main service.

In one aspect of the present invention, the SYNC channel may include identification information of a re-transmission service provided by the re-transmitter. The service identification information may directly include information identifying a type of the re-transmission service (e.g., a free or charged service). Alternatively, the service identification information may include a unique ID number of the re-transmission service. This ID number could be used by the broadcast receiver to determine a type of the re-transmission service.

In another aspect of the present invention, the SYNC channel may include identification information of the re-transmitter. The identification information of the re-transmitter may directly include information identifying a type of the re-transmission service (e.g., a free or charged service). Alternatively, the identification information of the re-transmitter may include a unique ID number of the re-transmitter, which could be used by the broadcast receiver to determine a type of the re-transmission service provided by the re-transmitter.

In another aspect of the present invention, a digital broadcast receiver includes a tuner, a demodulator, an information detector, a decoder, and a controller. The tuner receives a broadcast signal including main service data from a broadcast transmitter via a re-transmitter (e.g., gap-filler). The demodulator demodulates the broadcast signal, and the identification information detector detects identification information of a re-transmission service provided by the re-transmitter from the demodulated broadcast signal. Alternatively, the identification information may detect identification information of the re-transmitter from the demodulated broadcast signal. The decoder decodes the modulated broadcast signal, and the controller controls operation of the decoder based upon the identification information detected by the identification information detector.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1A:
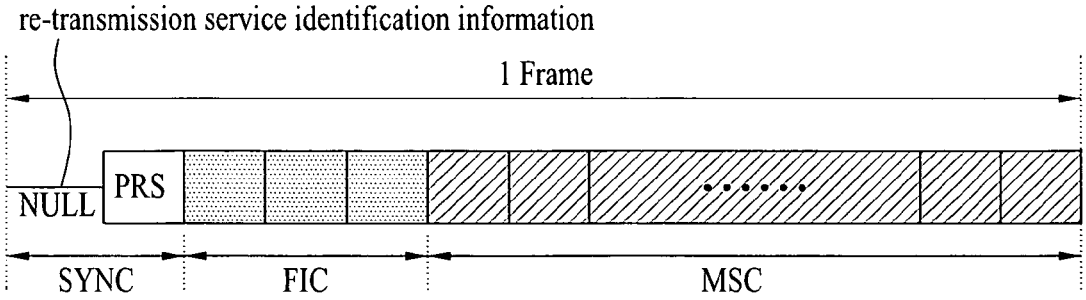
FIGS. 1A to 1E are exemplary views illustrating a DMB transmission frame according to the preferred embodiment of the present invention.
Figure 1B:
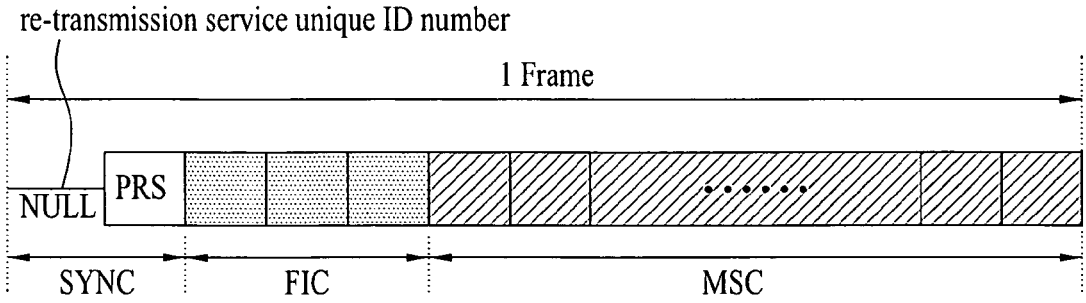
Figure 1C:
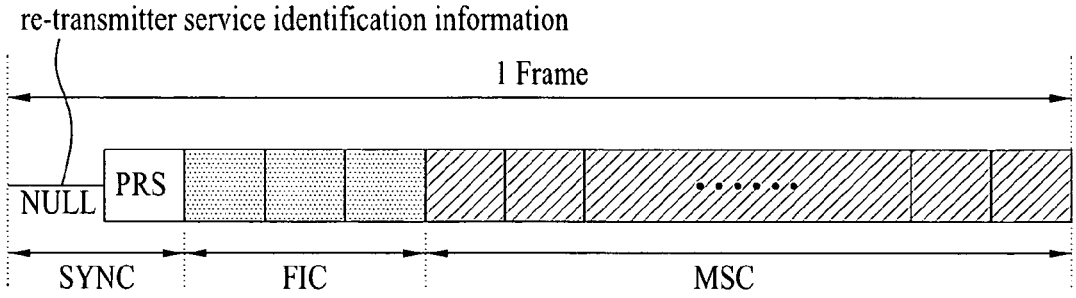
Figure 1D:
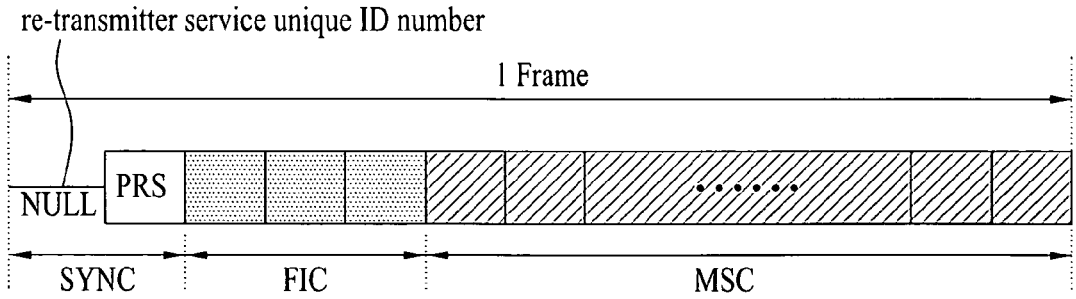

Reference will now be made in detail to the preferred embodiments of the present invention, examples of which are illustrated in the accompanying drawings. Wherever possible, the same reference numbers will be used throughout the drawings to refer to the same or like parts.

First Embodiment

The present invention is characterized in that a DMB service provider is provided with a re-transmitter and a receiver so as to allow the re-transmitter to re-transmit a DMB broadcast service received from a transmission node to the receiver and also allow the receiver to receive the DMB broadcast service depending on a service type.

In this case, in order that the receiver divisionally receives the DMB broadcast service depending on the service type, the re-transmitter carries out re-transmission by inserting re-transmission service identification information, re-transmission service unique ID number, re-transmitter identification information, or re-transmitter unique ID number in a transmission frame of the DMB service received from the transmission node.

The re-transmission service identification information represents information identifying a type of a re-transmission service provided by the re-transmitter. For example, the type of the re-transmission service may include a free or charged service.

The re-transmission service unique ID number represents a unique ID number of the re-transmission service provided by the re-transmitter.

The re-transmitter identification information represents information identifying a type of the re-transmission service provided by the re-transmitter. For example, the type of the re-transmission service may include a free or charged service.

The re-transmitter unique ID number represents a unique ID number of the re-transmitter that provides the re-transmission service.

Both the re-transmission service identification information and the re-transmitter identification information are identification information on the type of the re-transmission service directly transmitted from the re-transmitter to the receiver.

Also, both the re-transmission service unique ID number and the re-transmitter unique ID number are used to identify the re-transmission service provided by the re-transmitter by allowing the receiver to compare an ID number previously stored in a memory with the unique ID number corresponding to the type of the re-transmission service provided by the re-transmitter if the unique ID number corresponding to the type of the re-transmission service provided by the re-transmitter is transmitted to the receiver.

Accordingly, in the present invention, the receiver identifies the type of the re-transmission service or the re-transmitter using the above identification information, and divisionally receives the type of the re-transmission service or the re-transmitter depending on the identified result.

According to the present invention, the re-transmitter carries out re-transmission by inserting the re-transmission service identification information, the re-transmission service unique ID number, the re-transmitter identification information, or the re-transmitter unique ID number in the transmission frame. Hereinafter, such re-transmission of the re-transmitter will be described.

A Eureka-147 system will be described with regard to the DMB service. In the Eureka-147 system, single broadcasting service may include a plurality of service components. Also, a plurality of broadcasting services may be multiplexed and the multiplexed broadcasting services are transmitted through about 2 MHz frequency bandwidth. That is, the Eureka-147 system repeatedly transmits data in a frame unit structure.

The transmission frame will be described with reference to FIGS. 1A to 1E illustrating an example that the identification information is inserted in the transmission frame in accordance with the preferred embodiment of the present invention.

The transmission frame includes a synchronization channel (SYNC) for signal synchronization, a main service channel (MSC) to which actual service data are transmitted, and a fast information channel (FIC) to which data channel information transmitted through the MSC is transmitted.

The SYNC has a constant format determined to allow the receiver to recognize an initial frame, and transmits decoding information on a digital communication. A null symbol and a phase reference symbol (PRS) are included in the SYNC. The PRS is included for -DQPSK modulation/demodulation.

The MSC includes one or more common interleaved frames (CIF) and is used to transmit actual broadcast services such as video service, audio service and data service. Since data should be transmitted in the MSC without any error, error correction data are transmitted along with actual data. That is, video service, audio service and data service are transmitted to the MSC, and information on a sub-channel inside the MSC, to which actual data are transmitted, is transmitted through the FIC along with other required information.

Since the FIC aims to promptly transmit information, error correction data in addition to cyclic redundancy check (CRC) are not transmitted through the FIC. The FIC includes a plurality of fast information blocks (FIB) and is used to transmit various kinds of information for receiving the broadcast service.

At this time, the SYNC, the FIC and the MSC included in the transmission frame include several orthogonal frequency division multiplexing (OFDM) symbols. As an example, in case of a transmission mode 1, the PRS of the SYNC includes a single OFDM symbol, and the FIC and the MSC respectively include three OFDM symbols and seventy-two OFDM symbols. At this time, the respective OFDM symbols in one frame are differentially encoded based upon the PRS.

In other words, each service (audio service, video service and data service) at the transmission node is individually encoded to avoid any error and then interleaved in a time-domain. The interleaved services are multiplexed and added to the MSC that serves as a data channel. The multiplexed signals are interleaved in a frequency area along with multiplexing configuration information (MCI) and service information (SI) transmitted to the FIC that serves as a control channel. At this time, the information transmitted to the FIC does not allow time delay. Therefore, no interleaving is carried out in the time-domain.

A bit row interleaved in the frequency area is mapped with differential quaternary phase shift keying (DQPSK) symbols and then constitutes OFDM symbols through inverse fast fourier transform (IFFT). The OFDM symbols are modulated to RF signals and then transmitted.

Referring to FIGS. 1A to 1D, the re-transmission service identification information, the re-transmission service unique ID number, the re-transmitter identification information, or the re-transmitter unique ID number is inserted in a null symbol interval inside the SYNC of the transmission frame.

In other words, the re-transmitter inserts the identification information in the null symbol interval of the SYNC of the transmission frame to carry out re-transmission while the receiver identifies the type of the re-transmission service provided by the re-transmitter using the memory therein.

Figure 1E:
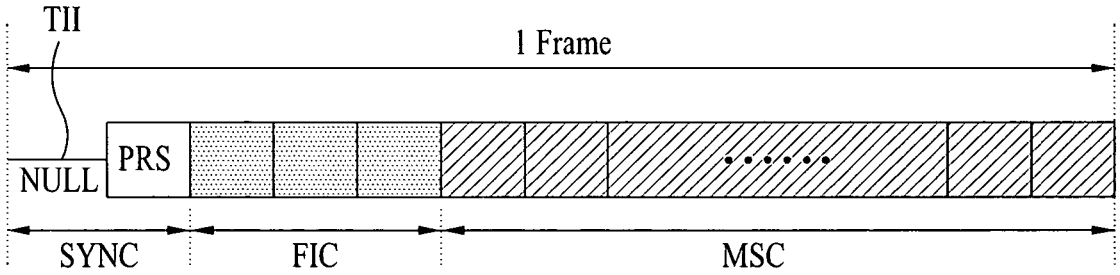

Furthermore, the re-transmitter, as shown in FIG. 1E, may insert transmitter identification information (TII) including the identification information in the null symbol interval of the transmission frame and transmit the TII to the receiver so as to obtain the aforementioned effect. At this time, the TII corresponds to unique information of the transmission node, and may be used to identify the position of the transmission node and retrieve services currently being broadcasted in a corresponding area. The transmission node may be a broadcasting station or a re-transmitter that provides the re-transmission service.

As described above, the re-transmitter carries out re-transmission by inserting the identification information as shown in FIGS. 1A to 1E, so that the receiver can divisionally receive the identification information depending on the type of the re-transmission service provided by the re-transmitter using the inserted identification information. For example, it is supposed that the receiver is located in a service shaded area and the type of the re-transmission service provided by the re-transmitter is divided into a charged service and a free service. In this case, if the re-transmission service provided by the re-transmitter provided to get ride of the service shaded area is a charged service, the receiver identifies the type of the received service to determine whether or not to receive it.

In other words, if the re-transmission service provided by the re-transmitter is a charged service, a user of the receiver is previously subscribed to the re-transmission service or is allowed to select whether or not to receive the re-transmission service even if the user is not subscribed to the re-transmission service. In this case, the user of the receiver may be charged for the re-transmission service in accordance with a previously set condition when selecting the re-transmission service. At this time, the previously set condition may include various options. As one example, the previously set condition includes a viewing time period of the DMB service re-transmitted from the re-transmitter.

Furthermore, if the user of the receiver is registered as a subscriber who receives the re-transmission service corresponding to a charged service, he/she may use the re-transmission service of the re-transmitter at a fixed sum system. Alternatively, the user of the receiver may be charged only if he/she uses the re-transmission service of the re-transmitter. In this case, it is preferable that the receiver selects whether or not to receive the re-transmission service re-transmitted from the re-transmitter at a charged service. At this time, the user may be provided with fee information on the re-transmission service of the re-transmitter and information on whether the re-transmission service is provided at a charged service in a type, such as text or sound, through the receiver.

Furthermore, if the re-transmission service is provided free of charge, the re-transmitter simply re-transmits a signal received from the broadcasting station or the transmission node without modifying a structure of the broadcast signal. The re-transmitter carries out re-transmission by inserting the identification information in the null symbol interval of the broadcast signal as shown in FIGS. 1A to 1E only if the re-transmission service corresponds to a charged service.

On condition that the re-transmitter provides the re-transmission service as above, the DMB broadcast service user can receive the broadcast signal re-transmitted from the re-transmitter without any problem if the re-transmission service is provided free of charge from the broadcasting station or the re-transmitter.

Accordingly, the re-transmitter carries out re-transmission as above only if the re-transmission service corresponds to a charged service, so that the receiver can receive the re-transmission service depending on the type of the re-transmission service.

Finally, the DMB broadcast service user divisionally receives the re-transmitted broadcast signal, whereby if the DMB broadcast service user desires to receive the DMB broadcast service even in a shaded area, he/she can receive a desired service of high quality by identifying a corresponding service.

Second Embodiment

Figure 2:
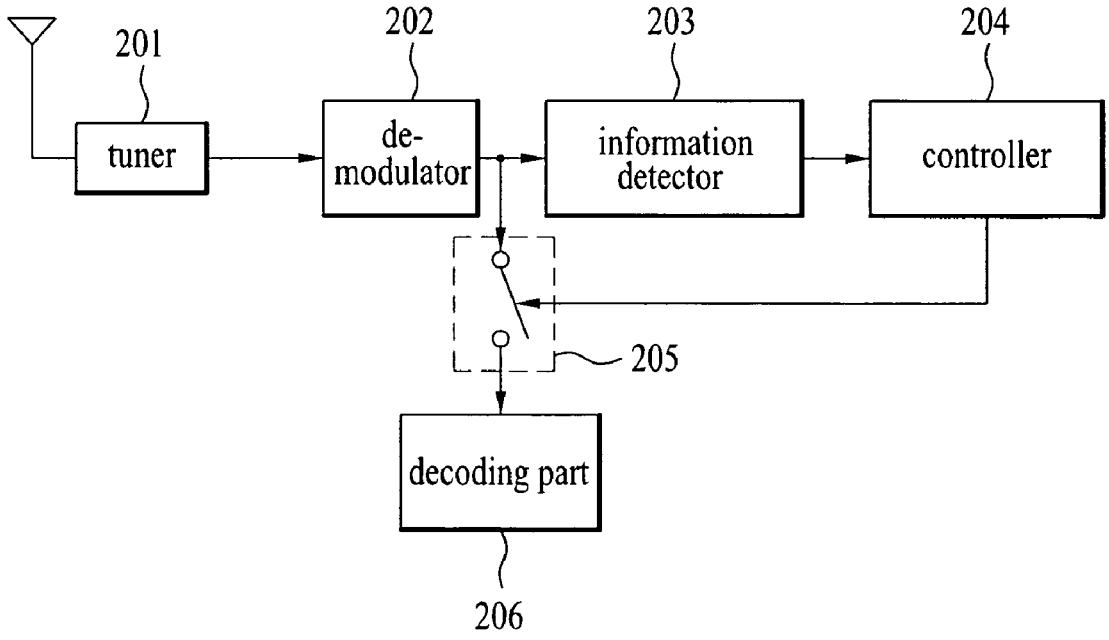
FIG. 2 is a block diagram illustrating an example of a DMB receiver according to the preferred embodiment of the present invention.

FIG. 2 is a block diagram illustrating an example of a DMB receiver according to the preferred embodiment of the present invention. Referring to FIG. 2, the receiver includes a tuner 201 tuned to receive a specific DMB service from an antenna, a demodulator 202 arranged to carry out A/D conversion, fast fourier transform (FFT), and OFDM demodulation for the DMB service tuned by the tuner 201, an information detector 203 detecting re-transmission service identification information, re-transmission unique ID number, re-transmitter identification information, or re-transmitter unique ID number included in the broadcast signal output from the demodulator 202, a controller 204 determining whether or not to decode the received DMB service using the extracted identification information and outputting a control signal in accordance with the determined result, a memory 205 previously storing information on the unique ID number so as to allow the controller 204 to determine whether or not to decode the received DMB service if the re-transmission unique ID number and the re-transmitter unique ID number are extracted from the information detector 203, a switch 206 switched on/off by the control signal of the controller 204 to control decoding of the DMB service demodulated by the demodulator 202, and a decoder 207 decoding the DMB service demodulated by the demodulator 202 and outputting the decoded result to be displayed if the switch 206 is switched on.

In other words, the tuner 201 tunes only an RF signal including the user's desired specific DMB service among services existing in various RF signals received from the antenna. The services existing in various RF signals are re-transmitted from the re-transmitter and include a charged service and a free service. Then, the tuner 201 converts the tuned signal to an intermediate frequency (IF) signal and outputs the IF signal to the demodulator 202.

The demodulator 202 sequentially carries out A/D conversion, FFT, and OFDM demodulation for the IF signal and then outputs the resultant value to the information detector 203 and the switch 206.

The information detector 203 detects the re-transmission service identification information, the re-transmission unique ID number, the re-transmitter identification information, or the re-transmitter unique ID number inserted in the transmission frame of the received DMB broadcast signal and outputs the extracted one to the controller 204.

The controller 204 determines whether or not to decode the DMB service in various manners using the identification information detected from the information detector 203. At this time, whether or not to decode the DMB service is determined depending on the type of the identification information. In other words, there are provided two cases, the one case where the re-transmission service identification information and the re-transmitter identification information are directly inserted to carry out re-transmission and the other case where the re-transmission unique ID number and the re-transmitter unique ID number are inserted to carry out re-transmission.

In the one case, it is determined how the amplitude of an interval where the identification information is inserted in a null symbol interval of the transmission frame of the broadcast signal is more dominant than a critical value previously set and stored in the receiver. Subsequently, it is determined whether or not to decode the received DMB service in accordance with the determined result.

For example, if the DMB service re-transmitted from the re-transmitter corresponds to a charged service, it is identified whether the user of the receiver is subscribed to the re-transmission service or whether the user selects reception of the re-transmission service. In other words, it is supposed that the DMB service re-transmitted from the re-transmitter corresponds to a charged service and is provided at a fixed sum system. In this case, if the user of the receiver is subscribed to the DMB service, the controller determines that the receiver can receive the DMB service, and outputs the control signal, which switches on the switch 206, to decode the DMB service.

Furthermore, supposing that the DMB service re-transmitted from the re-transmitter corresponds to a charged service and the DMB service fee is charged depending on a viewing time not a fixed sum system even if the user is subscribed to the DMB service, the receiver informs the user that the DMB service re-transmitted in a type of text or sound corresponds to a charged service, and allows the user to select whether or not to receive the DMB service. Also, it is preferable that the receiver is controlled to receive the DMB service only when selecting reception of the DMB service. This could be used even if the DMB. service re-transmitted from the re-transmitter corresponds to a charged service and the user is not subscribed to the DMB service.

The controller 204 outputs the control signal, which switches off the switch 206, so as not to decode the DMB service if the DMB receiver is not subscribed to the charged DMB service and does not select reception of the DMB service.

Next, in the other case, the re-transmitter re-transmits only the unique ID number with regard to the re-transmission service. Therefore, the receiver should determine the type of the received DMB service using only the unique ID number and also determine whether or not to decode the DMB service. To this end, the user of the receiver previously stores information on the re-transmission service and the unique ID number of the re-transmitter in the memory 205, and the information detector 203 detects the unique ID number and transmits to the controller. Subsequently, the controller 204 receives information on the corresponding unique ID number from the memory 205 and determines whether or not to decode the service related to the unique ID number using the information on the unique ID number.

In other words, if the re-transmitter carries out re-transmission by inserting the unique ID number in the null symbol interval of the transmission frame, the receiver detects the unique ID number from the information detector 203 and compares the detected unique ID number with the unique ID number stored in the memory 205.

At this time, information on the presence of a specific ID number, information on the type of the service provided by the re-transmitter having the unique ID number or information on the type of the re-transmission service provided by the re-transmitter (e.g., a charged or free service) are stored in the memory 205. The memory 205 transmits the information to the controller 204. The controller 204 compares the two ID numbers with each other to determine whether or not to decode the re-transmission service.

Meanwhile, the information detector 203 detects the re-transmission service identification information, the re-transmission service unique ID number, the re-transmitter identification information, or the re-transmitter unique ID number in the null symbol interval. However, if the DMB service re-transmitted from the re-transmitter is provided free of charge or no identification information is inserted in the DMB service, the controller 204 determines that the receiver directly receives the DMB service from the broadcasting station or receives the DMB service re-transmitted from the re-transmitter that provides the re-transmission service free of charge.

Accordingly, in this case, the controller 204 outputs the control signal, which switches on the switch 206, so as to decode the received DMB service and display the decoded DMB service.

Furthermore, the controller 204 outputs the control signal that switches on the switch 206 even if the signal amplitude of the interval including the re-transmission service identification information, the re-transmission service unique ID number, the re-transmitter identification information, or the re-transmitter unique ID number inserted in the null symbol interval of the broadcast signal re-transmitted from the re-transmitter is not greater than the critical value. This is because that the above case makes difficult to determine that the DMB service re-transmitted from the re-transmitter corresponds to a charged service.

The switch 206 is switched on to output the DMB service demodulated by the demodulator 202 to the decoder 207 if the controller 204 inputs the control signal that switches on the switch 206. However, the switch 206 is switched off so as not to output the DMB service demodulated by the demodulator 202 if the controller 204 inputs the control signal that switches off the switch 206.

The decoder 207 deinterleaves and decodes the DMB service demodulated by the demodulator 202 and output from the switch 206 as the switch 206 is switched on. That is, the decoder 207 deinterleaves the DMB service demodulated by the demodulator 202 in a frequency-domain and divides an FIC signal corresponding to a control channel from an MSC signal corresponding to a data channel. At this time, after the MSC signal is deinterleaved in a time-domain, video service components in the MSC are video-decoded, audio service components therein are audio-decoded, and data service components therein are data-decoded. At the same time, the FIC signal is also decoded.

Figure 3:
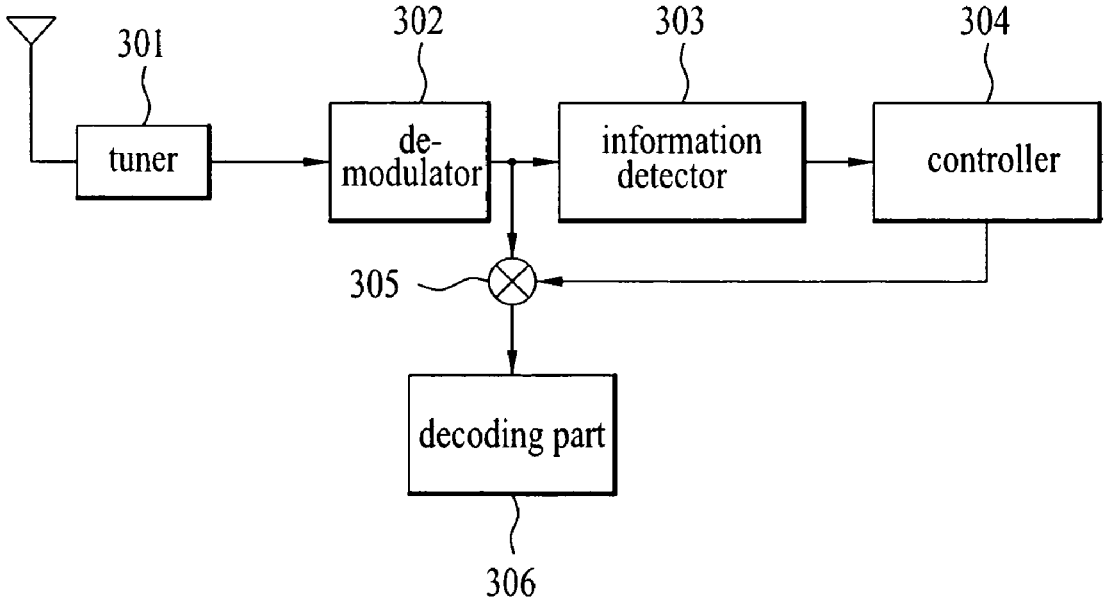
FIG. 3 is a block diagram illustrating another example of a DMB receiver according to the preferred embodiment of the present invention.

FIG. 3 is a block diagram illustrating another example of a DMB receiver according to the preferred embodiment of the present invention. Since other elements excluding a controller 304 and a multiplier 305 and their operation are the same as those of the DMB receiver described referring to FIG. 2, their detailed description will be omitted.

The controller 304 is different from that of the DMB receiver shown in FIG. 2 in decoding the received DMB service using the extracted identification information. The controller 304 will now be described in detail.

For example, the controller 304 determines how the signal amplitude of the interval in which the re-transmission service identification information, the re-transmission service unique ID number, the re-transmitter identification information, or the re-transmitter unique ID number is inserted is more dominant than the critical value previously set and stored in the receiver. Subsequently, the controller 304 identifies whether the receiver is subscribed to the DMB service re-transmitted from the re-transmitter or selects whether to receive the DMB service.

At this time, if the receiver is subscribed to the DMB service re-transmitted from the re-transmitter or selects whether to receive the DMB service, the controller 304 generates a signal amplitude control value $\alpha$ corresponding to "1" and outputs the control value to the multiplier 305.

The multiplier 305 multiplies the DMB service demodulated by the demodulator 302 by the signal amplitude control value $\alpha$ and outputs the resultant value to a decoder 306. At this time, since the signal amplitude control value $\alpha$ is equal to 1, a signal demodulated by the demodulator 302 is bypassed to the decoder 306 through the multiplier 305.

The signal amplitude control value $\alpha$ is determined by option of a designer and thus is not limited to "1." Therefore, the signal amplitude control value $\alpha$ may be greater or smaller than "1."

Meanwhile, if the receiver is not subscribed to the DMB service from the re-transmitter and does not select reception of the DMB serve, the controller 304 generates a signal amplitude control value $\alpha=1-\beta$ obtained by subtracting a signal amplitude $\beta$ corresponding to the interval where the identification information is inserted, from the signal amplitude control value "1" and outputs the generated signal amplitude control value to the multiplier 305.

The multiplier 305 multiplies the DMB service signal demodulated by the demodulator 302 by the signal amplitude control value $\alpha$ and outputs the resultant value to the decoder 306. In other words, in another example of the DMB receiver according to the present invention, the amplitude of the DMB service signal input to the decoder 306 is controlled by a ratio between the whole signal amplitude and the signal amplitude of the interval where the re-transmission service identification information, the re-transmission service unique ID number, the re-transmitter identification information, or the re-transmitter unique ID number is inserted. This is to provide the user, who is not subscribed to the DMB service re-transmitted from the re-transmitter or does not select reception of the DMB service, with some DMB service free of charge.

For example, it is supposed that the re-transmission service identification information, the re-transmission service unique ID number, the re-transmitter identification information, or the re-transmitter unique ID number provided by the re-transmitter is detected and the signal amplitude of the interval where the identification information is inserted is equal to 0.7 greater than a critical value (e.g., 0.5). In this case, the signal amplitude control value $\alpha$ is equal to "1" if the receiver is subscribed to the DMB service re-transmitted from the re-transmitter or selects reception of the DMB service.

However, if the receiver is not subscribed to the DMB service re-transmitted from the re-transmitter or does not select reception of the DMB service, the signal amplitude control value $\alpha$ is equal to "0.3" ($\alpha=1-0.7$).

Accordingly, the multiplier 305 multiplies the DMB service signal demodulated by the demodulator 302 by 1 or 0.3 and outputs the resultant value to the decoder 306.

Meanwhile, the controller 304 determines that the DMB service re-transmitted from the re-transmitter or transmitted from the broadcasting station corresponds to a free serve if the re-transmission service identification information, the re-transmission service unique ID number, the re-transmitter identification information, or the re-transmitter unique ID number on the re-transmitter, which provides the re-transmission service free of charge, is inserted in the null symbol interval, or if no identification information is inserted therein.

At this time, the signal amplitude control value $\alpha$ is equal to "0.3," so that the DMB service signal demodulated by the demodulator 302 is bypassed to the decoder 306 through the multiplier 305.

Furthermore, even if the re-transmission service identification information, the re-transmission service unique ID number, the re-transmitter identification information, or the re-transmitter unique ID number is detected, the signal amplitude control value $\alpha$ is equal to "0.3" if the signal amplitude of the detected identification information is smaller than the critical value. Thus, the DMB service signal demodulated by the demodulator 302 is bypassed to the decoder through the multiplier 305.

The decoder 306 deinterleaves the DMB service output from the multiplier 305 and decodes the deinterleaved DMB service.

As described above, in the present invention, the re-transmitter carries out re-transmission by inserting the re-transmission service identification information, the re-transmission service unique ID number, the re-transmitter identification information, or the re-transmitter unique ID number in the null symbol interval of the transmission frame. In this case, even if a transmitting signal for a free or charged DMB service is generated, the transmitting signal does not interfere with a signal for a free DMB service re-transmitted from the re-transmitter. This does not affect the receiver for the free DMB service. As a result, equipment of the re-transmitter for the terrestrial DMB service could be provided actively.

Furthermore, in the present invention, the re-transmitter may regularly or irregularly modify the re-transmission service identification information, the re-transmission service unique ID number, the re-transmitter identification information, or the re-transmitter unique ID number. As one example, if a service provided by a specific re-transmitter is modified from a charged service to a free service or vice versa, the re-transmitter modifies the identification information. At this time, the re-transmitter may modify either only information on a free/charged service or a corresponding re-transmitter ID.

In other words, in the present invention, the identification information is variably set as the case may be in the same manner as entitlement checking messages (ECM) and entitlement management messages (EMM) of a conditional access (CA) provided under the DMB standard.

Third Embodiment

Figure 4:
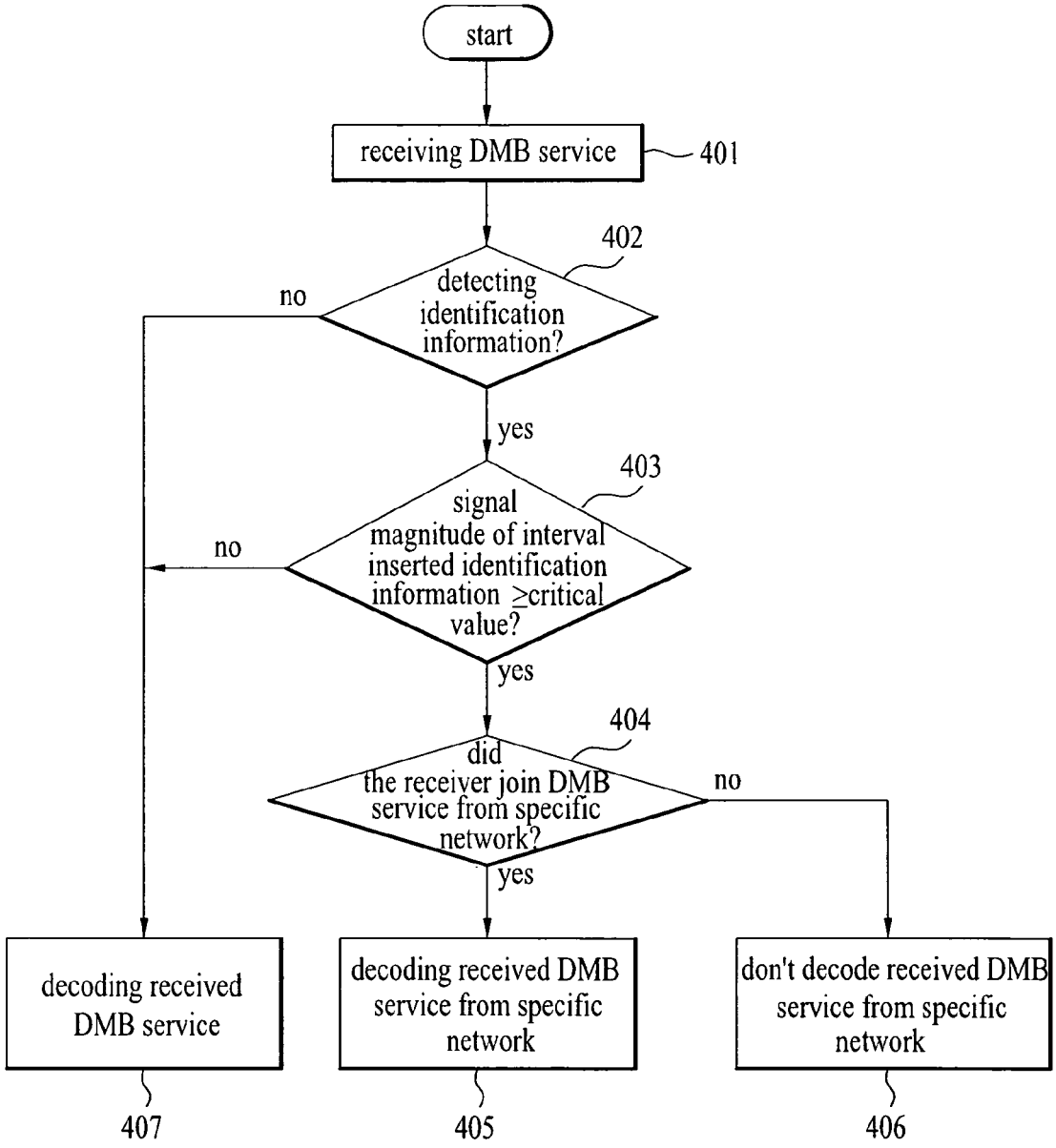
FIG. 4 is a flow chart illustrating a method of receiving a DMB service in accordance with the preferred embodiment of the present invention.

FIG. 4 is a flow chart illustrating a method of receiving a DMB service in accordance with the preferred embodiment of the present invention. Referring to FIG. 4, the re-transmitter carries out re-transmission by inserting re-transmission service identification information and re-transmitter identification information in a null symbol interval of a transmission frame of a DMB broadcast signal received from a transmission node. The receiver divisionally receives the service re-transmitted from the re-transmitter using the identification information. In the method of receiving a DMB service, the re-transmission service type is divided into a charged service type and a free service type, and the identification information is inserted to carry out re-transmission only in case of the charged service type.

If the DMB receiver receives the DMB service re-transmitted from the re-transmitter (S401), the information detector 203 determines whether the re-transmission service identification information or the re-transmitter identification information is detected in the null symbol interval of the transmission frame of the received DMB service (S402).

As a result of the step S402, if the re-transmission service identification information or the re-transmitter identification information is not detected in the null symbol interval, the broadcasting station or the re-transmitter re-transmits the DMB service without inserting the identification information in the null symbol interval. In this case, it is determined that the received DMB service is a free service. Therefore, the received DMB service is decoded and displayed on a monitor (S407).

However, as a result of the step S402, if the re-transmission service identification information or the re-transmitter identification information is detected in the null symbol interval, the controller 204 compares the signal amplitude of the interval, in which the identification information is inserted, with a critical value to determine whether the signal amplitude of the interval is greater than the critical value (S403).

As a result of the step S403, if the signal amplitude of the interval, in which the identification information is inserted, is not greater than the critical value, the controller determines that the DMB service re-transmitted from the broadcasting station or the re-transmitter corresponds to a free service, and decodes the DMB service to display the decoded DMB service on the monitor (S407).

However, as a result of the step S403, if the signal amplitude of the interval, in which the identification information is inserted, is greater than or equal to the critical value, the controller determines that the DMB service re-transmitted from the re-transmitter corresponds to a charged service. In this case, the controller determines whether the user of the receiver is subscribed to the charged DMB service (S404).

As a result of the step S404, if the user of the receiver is subscribed to the charged DMB service, the controller 204 outputs a control signal to switch on the switch 206. The switch 206 transmits the signal demodulated by the demodulator 202 to the decoder 207 in accordance with the control signal. Therefore, the receiver decodes the DMB service re-transmitted from the re-transmitter to display the decoded DMB service on the monitor (S405).

However, as a result of the step S404, if the user of the receiver is not subscribed to the charged DMB service, the receiver does not decode the DMB service. Therefore, the controller 204 outputs a control signal to the switch 206 to switch off the switch 206. The switch 206 does not output the signal demodulated by the demodulator 202 to the decoder 207. As a result, the receiver neither decodes the DMB service re-transmitted from the re-transmitter nor displays the DMB service on the monitor (S406).

Meanwhile, if it is determined that the DMB service re-transmitted from the re-transmitter corresponds to a charged service in step S404, the user may select whether or not to receive the DMB serve. In this case, if the user selects reception of the DMB service re-transmitted from the re-transmitter, the receiver decodes the DMB service to display the decoded DMB service on the monitor.

Figure 5:
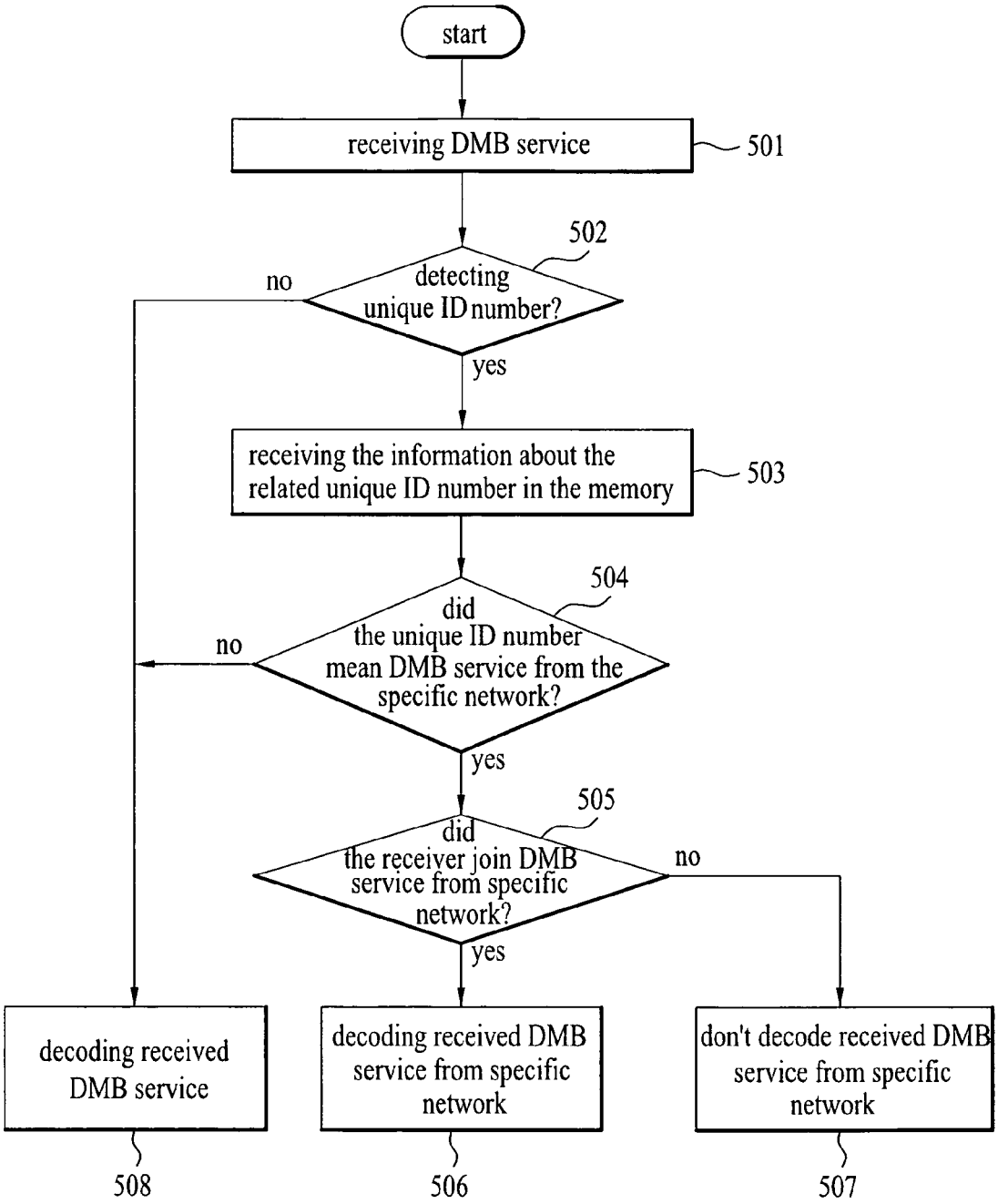
FIG. 5 is a flow chart illustrating another method of receiving a DMB service in accordance with the preferred embodiment of the present invention.

FIG. 5 is a flow chart illustrating another method of receiving a DMB service in accordance with the preferred embodiment of the present invention. Referring to FIG. 5, the re-transmitter carries out re-transmission by inserting re-transmission service unique ID number and re-transmitter unique ID number in a null symbol interval of a transmission frame of a DMB broadcast signal received from a transmission node. The receiver divisionally receives the service re-transmitted from the re-transmitter using the unique ID number as identification information. In this method of receiving a DMB service, the re-transmission service type is divided into a charged service type and a free service type, and the identification information is inserted to carry out re-transmission only in case of the charged service type.

If the DMB receiver receives the DMB service re-transmitted from the re-transmitter (S501), the information detector 203 of the receiver determines whether the re-transmission service unique ID number or the re-transmitter unique ID number is detected in the null symbol interval of the transmission frame of the received DMB service (S502).

As a result of the step S502, if the re-transmission service unique ID number or the re-transmitter unique ID number is not detected in the null symbol interval, the broadcasting station or the re-transmitter re-transmits the DMB service without inserting the identification information in the null symbol interval. In this case, it is determined that the received DMB service is a free service. Therefore, the received DMB service is decoded and displayed on a monitor (S508).

However, as a result of the step S502, if the re-transmission service unique ID number or the re-transmitter unique ID number is detected in the null symbol interval, the controller 204 receives information on the unique ID number from the memory 205 (S503).

The controller 204 identifies the type of the received re-transmission service using the information on the unique ID number received from the memory 205. As a result, if the received service is a free service or there is no information on the unique ID number, the controller 204 determines that the service corresponds to a free service and decodes the service to display the decoded service on the monitor (S508).

However, if the received service corresponds to a charged service, the controller 204 determines whether the receiver is subscribed to the service (S505).

As a result of the step S505, if the receiver is not subscribed to the service or if the user does not select reception of the service due to a non-fixed sum system even in case where the receiver is subscribed to the service, the receiver fails to receive the service. Therefore, the controller 204 outputs the control signal, which switches off the switch 206, to the switch 206. The switch 206 neither decodes the signal demodulated by the demodulator 202 nor displays the signal on the monitor (S506).

However, as a result of the step S505, if the receiver is subscribed to the service at a fixed sum system, the receiver can receive the service. Therefore, the controller 204 outputs the control signal, which switches on the switch 206, to the switch 206. The switch 206 decodes the signal demodulated by the demodulator 202 to display the decoded signal on the monitor (S507).

Preferably, if the receiver is not subscribed to the service or if the receiver is subscribed to the service at a non-fixed sum system, information on whether to receive the charged service is transmitted to the user so as to allow the user to select reception of the service and determine whether to decode the service in accordance with the user's selection.

Meanwhile, terminologies used in the present invention are defined considering functions in the present invention and may be changed depending on the skilled person's intention in the art or practices. Therefore, the terminologies should be defined based upon the whole description of the present invention.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of processing a re-transmission service in a digital broadcast receiver, the method comprising:

receiving a re-transmission service from a re-transmitter, wherein the re-transmission service includes a digital broadcast signal transmitted from a broadcast transmitter; and decoding the received re-transmission service, wherein the step of decoding includes: being determined based upon identification information identifying the re-transmitter and indicating whether the received re-transmission service is decoded in the digital broadcast receiver or not, comparing an amplitude of a broadcasting signal including the identification information with a predefined value when the re-transmission service is identified as a charged service, and allowing a decoder to decode the re-transmission service data when the amplitude of the signal is greater than the predefined value, and wherein the re-transmitter inserts new information to add the identification information in the retransmission service.

2. The method of claim 1, further comprising:

determining whether a user is a subscriber to the re-transmission service when the re-transmission service is identified as a charged service; and allowing the decoder to decode the re-transmission service data when the user is determined to be the subscriber.

3. The method of claim 1, further comprising:

determining whether a user makes an order to use the re-transmission service when the re-transmission service is identified as a charged service; and allowing the decoder to decode the re-transmission service data when the user makes the order.

4. The method of claim 1, further comprising:

multiplying the received re-transmission service by a signal amplitude control value; and outputting a resultant value.

5. The method of claim 4, wherein the signal amplitude control value is determined based upon whether a signal amplitude of the received re-transmission is greater than a predefined value as a charged service.

6. The method of claim 1, wherein the identification information is included in transmitter identification information (TII) which includes identification information of the broadcast transmitter.

7. The method of claim 1, wherein the re-transmission service data includes at least one of audio, video, and data service data.

8. A digital broadcast receiver processing a re-transmission service comprising:

a receiving unit for receiving a re-transmission service from a re-transmitter, the transmission service includes a digital broadcast signal transmitted from a broadcast transmitter;

a demodulator for demodulating the received re-transmission service;

a decoder for decoding the demodulated re-transmission service; and a controller for controlling an operation of the decoder based upon identification information identifying the re-transmitter and indicating whether the received re-transmission service is decoded in the digital broadcast receiver or not, wherein the re-transmitter inserts new information to add the identification information in the retransmission service, and the controller allows the decoder to decode the re-transmission service data when the re-transmission service is identified as a charged service and an amplitude of a signal including the identification information is greater than a predefined value.

9. The digital broadcast receiver of claim 8, wherein the controller controls to detect the identification information which identifies whether the re-transmission service is a charged service or not.

10. The digital broadcast receiver of claim 8, wherein the controller allows the decoder to decode the re-transmission service data when the re-transmission service is identified as a charged service and a user is determined to be a subscriber to the re-transmission service.

11. The digital broadcast receiver of claim 8, wherein the controller allows the decoder to decode the re-transmission service data when the re-transmission service is identified as a charged service and a user makes an order to use the re-transmission service.

12. The digital broadcast receiver of claim 8, further comprising;

a multiplier for multiplying the demodulating re-transmission service by a signal amplitude control value and outputting a resultant value to the decoder.

13. The digital broadcast receiver of claim 12, wherein the signal amplitude control value is determined based upon whether a signal amplitude of the received re-transmission is greater than a predefined value as a charged service.

14. The digital broadcast receiver of claim 8, wherein the controller controls the information detector to detect the identification information, wherein the identification is included in transmitter identification information (TII) which includes identification information of the broadcast transmitter.

15. The digital broadcast receiver of claim 8, wherein the controller controls the decoder to decode the re-transmission service data, wherein the re-transmission service data includes at least one of audio, video, and data service data.

16. A method of processing a re-transmission service in a digital broadcast receiver, the method comprising:

receiving a re-transmission service from a re-transmitter, wherein the re-transmission service carries a digital broadcast signal transmitted from a broadcast transmitter and identification information identifying a unique identifier (ID) number of the re-transmitter inserted by the re-transmitter;

determining whether the re-transmitter provides a charged service from a service type identified by information corresponding to the received identification information in a memory;

determining whether the digital broadcast receiver is to a subscriber of the charged service if the re-transmitter provides the charged service; and decoding the received re-transmission service, if it is determined that the digital broadcast receiver is to a subscriber of the charged service, wherein the step of decoding includes:

comparing an amplitude of a broadcasting signal including the identification information with a predefined value when the re-transmission service is identified as a charged service, and allowing a decoder to decode the re-transmission service data when the amplitude of the signal is greater than the predefined value, wherein the digital broadcast receiver previously stores information identifying a service type of the re-transmitter, and wherein the service type of the re-transmitter is any one of a charged service and a free service.

17. A digital broadcast receiver processing a re-transmission service comprising:

a receiving unit for receiving a re-transmission service from a re-transmitter, wherein the re-transmission service carries a digital broadcast signal transmitted from a broadcast transmitter and identification information identifying a unique identifier (ID) number of the re-transmitter inserted by the re-transmitter;

a demodulator for demodulating the received re-transmission service;

a memory;

a controller for controlling to determine whether the re-transmitter provides a charged service from a service type identified by information corresponding to the received identification information in the memory, and whether the digital broadcast receiver is to a subscriber of the charged service if the re-transmitter provides the charged service, and the controller allows a decoder to decode the re-transmission service data when the re-transmission service is identified as a charged service and an amplitude of a signal including the identification information is greater than a predefined value and the decoder for decoding the received re-transmission service, if it is determined that the broadcast receiver is to a subscriber of the charged service, wherein the digital broadcast receiver previously stores information identifying a service type of the re-transmitter, and wherein the service type of the re-transmitter is any one of a charged service and a free service.

* * * * *